US009183696B2

(12) United States Patent
Lim et al.

(10) Patent No.: US 9,183,696 B2
(45) Date of Patent: Nov. 10, 2015

(54) MERCHANDISER AND METHOD OF CONTROLLING GAME THEREOF

(71) Applicant: ANDAMIRO CO., LTD., Gyeonggi-do (KR)

(72) Inventors: Myoung Soo Lim, Seoul (KR); Jong Sam Yoon, Seoul (KR); Do Young Kim, Gyeonggi-do (KR)

(73) Assignee: ANDAMIRO CO., LTD., Gyeonggi-do (KR)

( * ) Notice: Subject to any disclaimer, the term of this patent is extended or adjusted under 35 U.S.C. 154(b) by 0 days.

(21) Appl. No.: 13/960,803

(22) Filed: Aug. 7, 2013

(65) Prior Publication Data

US 2014/0045565 A1 Feb. 13, 2014

(30) Foreign Application Priority Data

Aug. 7, 2012 (KR) ..... 10-2012-0086319
Jun. 18, 2013 (KR) ..... 10-2013-0069537

(51) Int. Cl.
*A63B 67/00* (2006.01)
*A63B 71/00* (2006.01)
*G07F 17/32* (2006.01)

(52) U.S. Cl.
CPC ..... *G07F 17/32* (2013.01); *G07F 17/3253* (2013.01)

(58) Field of Classification Search
None
See application file for complete search history.

(56) References Cited

U.S. PATENT DOCUMENTS

| | | | | | |
|---|---|---|---|---|---|
| 5,558,340 | A * | 9/1996 | Ibe et al. | ..... | 273/448 |
| 6,139,017 | A * | 10/2000 | Kawamura | ..... | 273/445 |
| 6,315,157 | B1 * | 11/2001 | Halliburton | ..... | 221/87 |
| 8,079,597 | B1 * | 12/2011 | Wei | ..... | 273/451 |
| 8,167,311 | B1 * | 5/2012 | Wang | ..... | 273/451 |
| 8,448,948 | B1 * | 5/2013 | Shoemaker, Jr. | ..... | 273/447 |
| 8,608,171 | B1 * | 12/2013 | Wang | ..... | 273/447 |
| 2002/0175471 | A1 * | 11/2002 | Faith | ..... | 273/440 |
| 2011/0272887 | A1 * | 11/2011 | McGrath | ..... | 273/448 |
| 2012/0158483 | A1 * | 6/2012 | Lee et al. | ..... | 705/14.36 |

FOREIGN PATENT DOCUMENTS

| | | | |
|---|---|---|---|
| JP | 2000-262733 | A | 9/2000 |
| KR | 10-2008-0070430 | A | 7/2008 |

OTHER PUBLICATIONS

Emily Jed, Sega Rolls Out Key Master Prize-Vending Game After Success in Tests, Jun. 2, 2011, http://www.vendingtimes.com/ME2/dirmod.asp?nm=Music+%26+Games+Features&type=Publishing&mod=Publications%3A%3AArticle&tier=4&id=E7D576B39B9E41FF9EDA3D4FD72061EE.*

* cited by examiner

*Primary Examiner* — Dmitry Suhol
*Assistant Examiner* — Jason Yen
(74) *Attorney, Agent, or Firm* — The PL Law Group, PLLC

(57) ABSTRACT

A merchandiser and a method of controlling a game thereof are disclosed. The merchandiser includes prize cartridges that have transparent partitions among which prizes are contained, drive parts that move the respective prize cartridges, a gaming device that executes a game provided for each of identification numbers of the prize cartridges, and a controller that controls the drive part so that the prize of the prize cartridge is dropped to a prize discharge part according to a result of playing the game. Thereby, since a designated prize can be acquired according to the result of playing a game, an interest in the game can be increased.

18 Claims, 14 Drawing Sheets

MERCHANDISER AND METHOD OF CONTROLLING GAME THEREOF

CROSS-REFERENCE TO RELATED APPLICATION

This application claims priority to and the benefit of Korean Patent Application No. 2012-0086319, filed on Aug. 7, 2012, and Korean Patent Application No. 2013-0069537, filed on Jun. 18, 2013, the disclosure of which is incorporated herein by reference in its entirety.

BACKGROUND

1. Field of the Invention

The present invention relates to a merchandiser, and more particularly, to a merchandiser that is installed, for instance, in an amusement park arcade. The merchandiser allows people to play a game associated with a desired prize, and discharges the corresponding prize according to a result of playing the game. A method of controlling a game thereof is also described.

2. Discussion of Related Art

In general, merchandisers designed to augment a sense of fulfillment or entertainment, in addition to the purpose of playing a game in a game room or arcade, has recently become popular, and a heavy investment has been made in the development of merchandisers.

FIG. 1 shows a conventional merchandiser that is disclosed in Korean Registered Utility Model No. 20-0245379 (Titled "Prize Discharge Actuator") and provides a prize according to a result of a game. The merchandiser includes a belt frame 3 installed in the front of a body a, a belt 2 formed in the belt frame, prize hanging grooves 1 formed on the belt 2, a control unit b, and a speed reduction unit c installed in the rear of the body a. The merchandiser further includes a driving gear 4 driving the belt 2, a switch 5 stopping the discharge of a prize, and an operation control board 6 installed in the control unit b. Further, a reduction gear is installed in the speed reduction unit c and is connected to a motor 7.

FIG. 2 shows another conventional merchandiser. Prizes are hanging on a screw-shaped prize hanging assembly with strings for exhibition. A motor rotates the screw-shaped prize hanging assembly, and the prizes exhibited on the prize hanging assembly are moved forward in a rotating direction and are discharged by free fall at an end of the prize hanging assembly.

These merchandisers are developed in various well-known structures such as an inertial structure or in a rotation push-structure that are frequently used in vending machines.

These structures have problems in that they are considerably complicated, require a great deal of production costs, and are bulky. Particularly, since the machines are complicated, the exhibited prizes are slightly exposed, and an exhibition effect cannot be expected. There is additionally a problem in that an exhibition part is separately installed.

Further, when the motor is merely driven, the prize is not stopped at an accurate position and is inconsistently pushed. When the prize is hanging at a short distance, it may be prematurely discharged.

When the prizes are hung, they cannot be uniformly hung, which leads to slight inconveniences.

SUMMARY

The present invention is directed to a merchandiser that corrects drawbacks of a poorly designed screw type, enables a player to check prizes with the naked eye, and enables a player to play a game to which a desired prize is assigned, and a method of controlling a game thereof is also described.

According to an aspect of the present invention, there is provided a merchandiser that provides a designated prize according to a result of playing a game. The merchandiser includes: one or more prize cartridges that have partitions among which prizes are contained, and the prize cartridges are distinguished by different identification numbers; drive parts that drive the respective prize cartridges in a forward/backward direction and have front sensors limiting the forward movement distance; a gaming device that executes the game provided for each of the identification numbers of the prize cartridges; a prize discharge part from which the contained prizes are discharged; a controller that drives the drive part when a result of playing the game of the gaming device is determined to be a win, and moves the prize cartridge in a forward direction so that the prize is dropped to the prize discharge part.

Here, the controller may control the drive part when it is detected by input detectors or the front sensor that the prize of the prize cartridge is input to the prize discharge part so that the prize cartridge is moved in a backward direction. The prize discharge part may further include a blocking wall that is operated in an unlocked state, in which the prize, input by pivoting, is discharged and in a locked state whereby the input prize is hindered from being discharged, and the controller may control the blocking wall in the unlocked state when the result of playing the game of the gaming device is determined to be a win, so that the prize input to the prize discharge part is discharged.

Further, the controller may control the blocking wall in the locked state when a predetermined time has elapsed after it is detected by the input detectors or the front sensor that the prize of the prize cartridge is input to the prize discharge part, so that an illegal acquisition of the prize can be prevented.

The prize discharge part may further include a door pivoting around a rotational shaft with an upper end thereof, and a stopper preventing the pivoting of the door. The controller may control the stopper when it is detected by input detectors or the front sensor that the prize is input to the prize discharge part so as not to hinder the pivoting of the door and so as to prevent the pivoting of the door after a predetermined time has elapsed.

Further, the prize discharge part may further include a motor and a door that is rotatably coupled with the motor and pivots around a rotational shaft with an upper end thereof according to rotation of the motor, and the controller may control the motor when it is detected by the input detectors or the front sensor that the prize is input to the prize discharge part so as not to hinder the pivoting of the door and so as to prevent the pivoting of the door after a predetermined time has elapsed.

Also, the drive part may include: a base bracket; a bracket that is mounted on the base bracket and supports one end of the prize cartridge; an electroformed screw rod that couples the bracket with a nut; and a motor that rotates the electroformed screw rod. The bracket may be moved backward and forward while the electroformed screw rod is rotated by rotation of the motor, thereby controlling the prize in the prize cartridge to drop.

To this end, the prize cartridge may include: a rear plate supported by a bracket of the drive part; opposite lateral plates that are coupled to opposite ends of the rear plate and has one or more fitting slits in an exhibited direction of the prizes; partitions that are fitted into the fitting slits depending on a size of the prize; and guide grooves into which lower portions of the opposite lateral plates are inserted and guided so as to slide.

The gaming device may include: an extruder that has a rod-like member moving in a forward/backward (Z) direction; a wall plate that has window holes and blocks the front; a support bracket that supports the wall plate and is marked with the identification numbers of the prize cartridges; and a key operator that moves the extruder in a leftward/rightward (X) direction. When the key operator is operated to move the extruder in the X direction, the rod-like member may be moved in the Z direction, and then, when a tip of the rod-like member is inserted into and passes through the window hole, the controller may control the drive part so that the prize corresponding to the identification number of the penetrated wall plate is input to the prize discharge part.

Further, the gaming device may include: an extruder that has a rod-like member moving in a forward/backward (Z) direction; a wall plate that has window holes and blocks the front; a support bracket that supports the wall plate and is marked with the identification numbers of the prize cartridges; and a key operator that moves the extruder in an upward/downward (Y) direction. When the key operator is operated to move the extruder in the Y direction, the rod-like member may be moved in the Z direction, and then, when a tip of the rod-like member is inserted into and passes through the window hole, the controller may control the drive part so that the prize corresponding to the identification number of the penetrated wall plate is input to the prize discharge part.

According to another aspect of the present invention, there is provided a merchandiser that provides a designated prize according to a result of playing a game. The merchandiser includes: a box-shaped frame, at least one face of which is transparent so as to look inside; a prize showcase in which prizes are exhibited on one plane of the frame in a matrix pattern at a leftward/rightward (X) or upward/downward (Y) exhibition position and are contained by partitions, and have different identification numbers; one or more targets which are provided on the same plane as the prize showcase, in which wall plates having window holes blocking the front and are disposed in a leftward/rightward (X) or upward/downward (Y) direction, which are also marked with different identification numbers of the prize showcase; an extruder having a rod-like member moving in a direction (Z) in which the targets are located within a plane located outside the showcase; and a key operator moving the extruder in the leftward/rightward (X) or upward/downward (Y) direction.

Thus, according to the merchandiser of the present invention and the method of controlling a game thereof, losses caused by a malfunction of the apparatus can be minimized, and manufacturing costs can be reduced due to easy mounting of a manufacturer. Also, an effect of exhibiting the prizes can be increased.

Further, a game by which a desired prize is designated, is selected and played, thereby, an interest in the game can be increased.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereinafter, the terms or words used in the specification and claims are not to be interpreted by their typical or dictionary meanings but their meanings and concepts should be construed in conformity with the technical idea of the invention, based on the principle that the inventor can properly define the concepts of the terms so as to explain the invention in the best manner.

Throughout the specification, when a certain portion "includes" a certain component this indicates that the other components are not excluded, and may be further included unless otherwise noted. The terms "unit," "-or/er," and "module" described in the specification indicate a unit for processing at least one function or operation, which may be implemented by hardware, software, or a combination thereof.

Exemplary embodiments of the present invention will be described in detail below with reference to the accompanying drawings.

Figure 1:
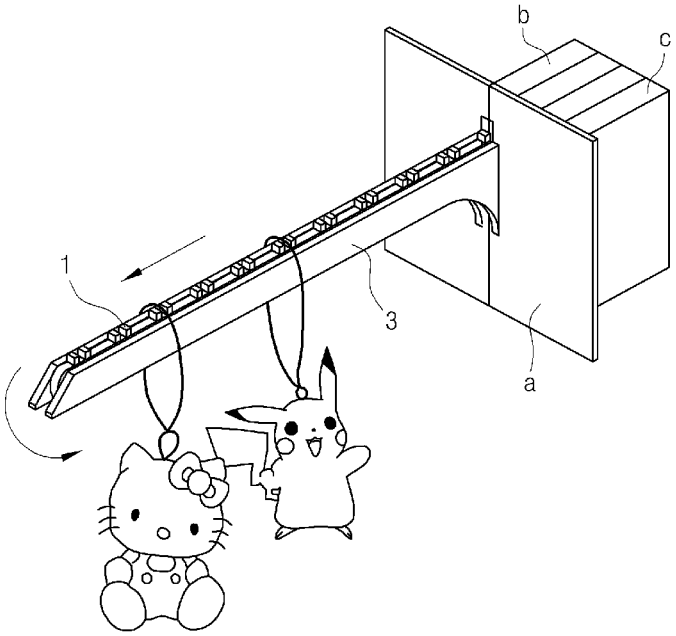
FIG. 1 shows an example of a conventional merchandiser.
Figure 2:
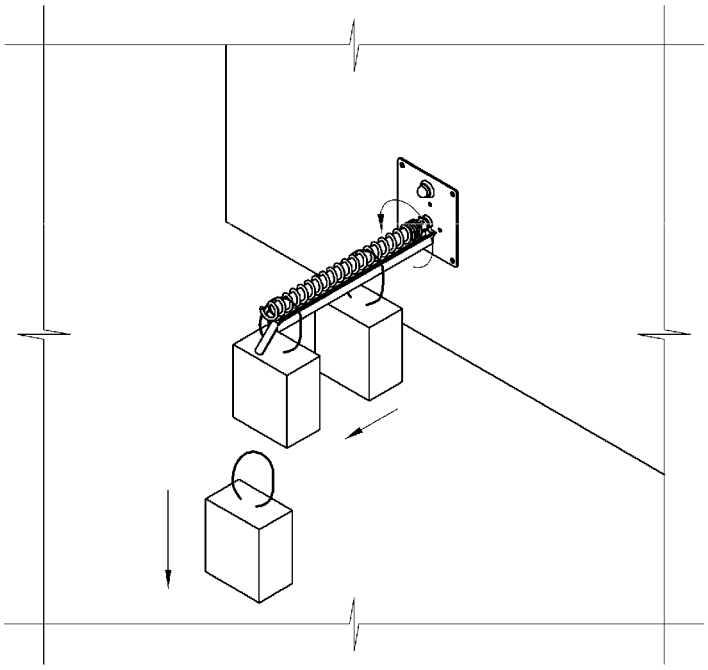
FIG. 2 shows another example of a conventional merchandiser.
Figure 3:
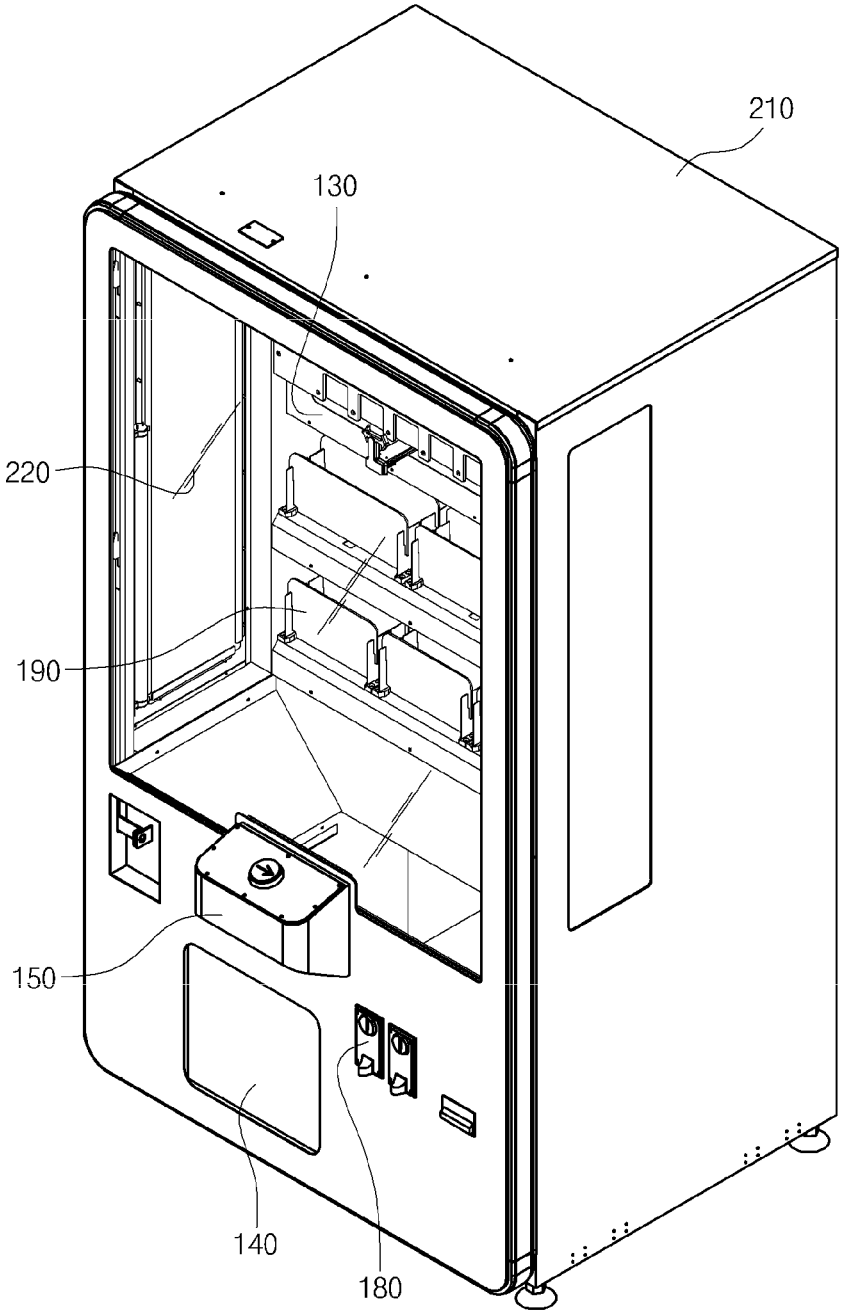
FIG. 3 is a perspective view of a merchandiser according to an embodiment of the present invention.
Figure 4:
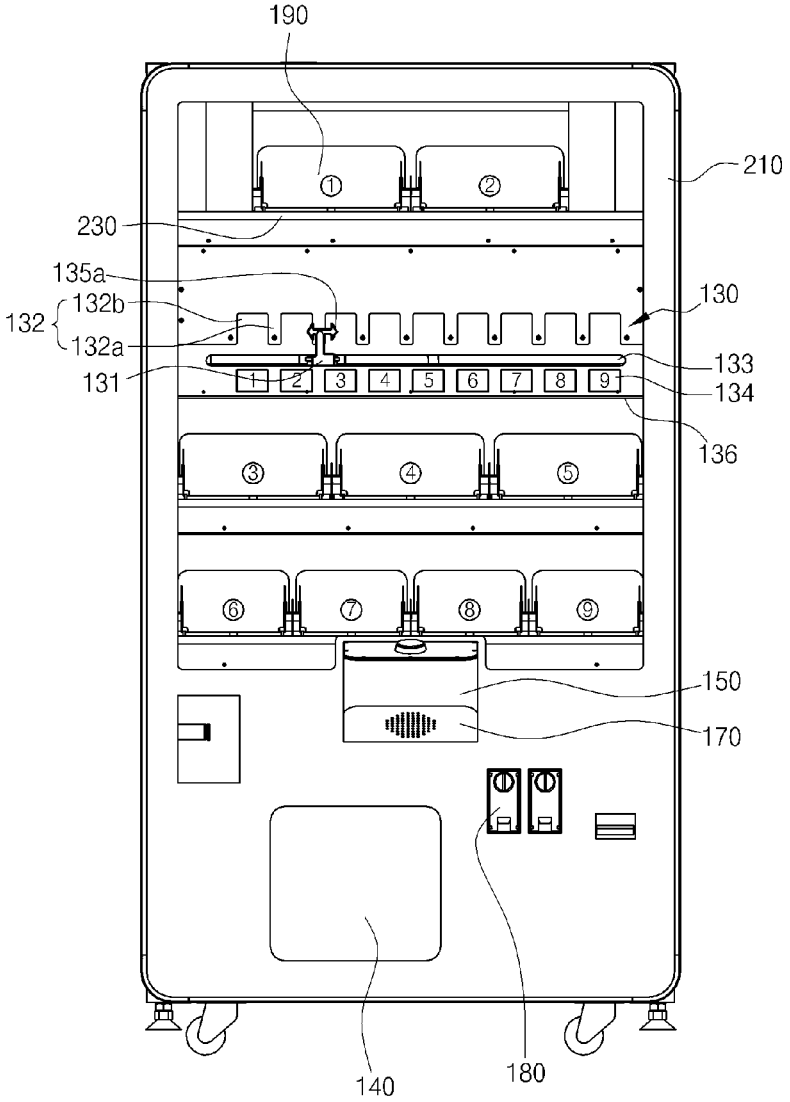
FIG. 4 is a front view of the merchandiser of FIG. 3.
Figure 5:
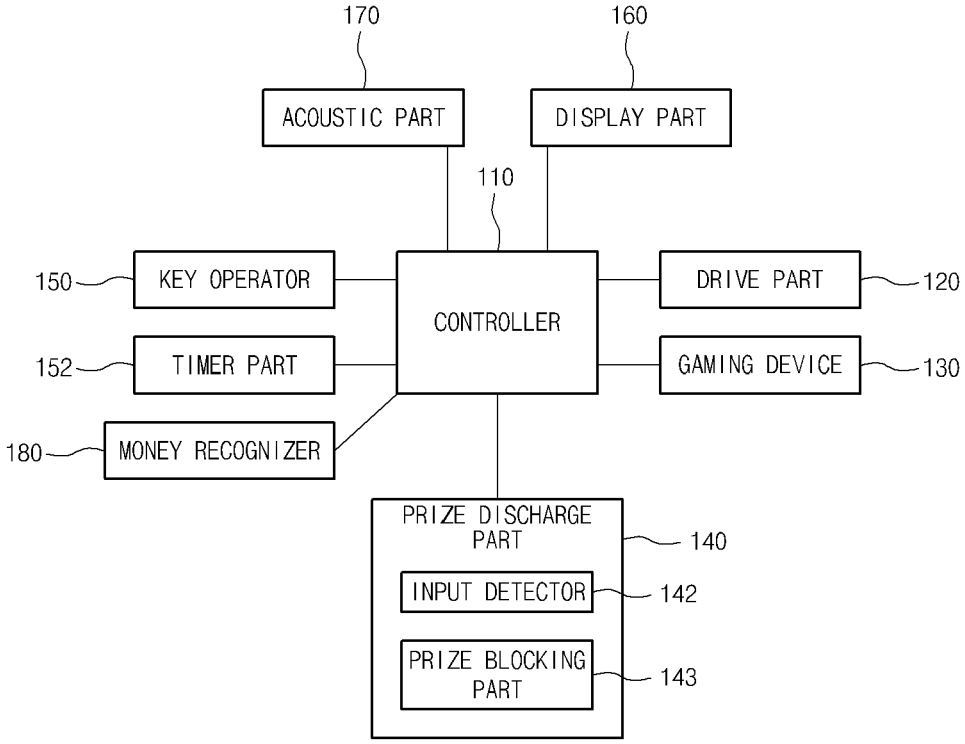
FIG. 5 is a block diagram showing primary components of the merchandiser according to the embodiment of the present invention.

FIG. 3 is a perspective view of a merchandiser according to an embodiment of the present invention. FIG. 4 is a front view of FIG. 3. FIG. 5 is a block diagram showing primary components of the merchandiser according to the embodiment of the present invention. As shown, the merchandiser according to the embodiment of the present invention includes a box-shaped frame 210, at least one face of which is transparent so as to look inside, a prize showcase 220 in which prize cartridges 190 are exhibited at one side of the interior of the frame 210, a gaming device 130 provided at the other side of the interior of the frame 210, a key operator 150 that is installed outside the frame 210 and has buttons required for a game, a prize discharge part 140 provided at a lower side of the exterior of the frame, an acoustic part 170 for generating sound effects, and a money recognizer 180.

The prize discharge part 140 includes an outlet through which a prize, such as a coin or ticket, is discharged and which is located at a lower side of the front of the frame 210, so as to enable a player to pick up the prize, and an input detector 142 which is installed therein that detects whether or not the prize is input.

An operation of the input detector will be described below in detail.

The money recognizer 180 may be made up of a coin sensor that detects coins input into a coin slot, a bill sensor that detects bills input into a bill slot, and a card sensor that detects cards or substitutes input into a card reader.

The acoustic part 170 typically generates sound effects required to play games in order to stimulate interest in the games. Such sound effects are activated by an ordinary program within a controller 110 in advance.

Further, the controller 110 may output a message informing a player that a door is closing, as needed, so as to enable a player to take out the prize before the door is closed.

A display part 160 is designed to be turned on or off in order to increase a visual effect or interest in the game and may be installed at various positions of the merchandiser. To this end, the display part 160 may be made up of a seven-segment display or light-emitting diode (LED). The display part 160 may display the obverse and reverse of the coin, a score or a number, a bonus score, the prizes that are detected by control of the controller 110, a Jackpot Game, or the number of available remaining coins.

Further, the controller 110 controls the display part 160 to display a message informing a player that a door is closing, as needed, so as to enable a player to take out the prize before the door is closed.

The prize showcase 220 includes a plurality of prize cartridges 190 in which prizes 194 are contained in a forward/backward (Z) direction so as to be exhibited on one plane of the frame 210 in a matrix pattern at a leftward/rightward (X) or upward/downward (Y) exhibition position and which have different identification numbers 134, and drive parts 120 driving the respective prize cartridges 190.

Each prize cartridge 190 stores the prizes 194 and is operated according to a result of the gaming device 130 so that the prizes 194 fall to the prize discharge part 140 one-by-one by driving of the corresponding drive part 120.

In other words, according to a result of playing a game, the prize is discharged. To this end, each prize cartridge 190 has partitions 192 among which the prizes 194 are contained and is distinguished from the others with the designated identification number. At least one different prize is provided and mounted in each of the partitions 192.

This constitution enables the player to easily check the exhibited prizes and the identification number 134 of the prize cartridge 190 in which the desired prize 194 is contained, and to play a game corresponding to the desired prize.

Figure 6:
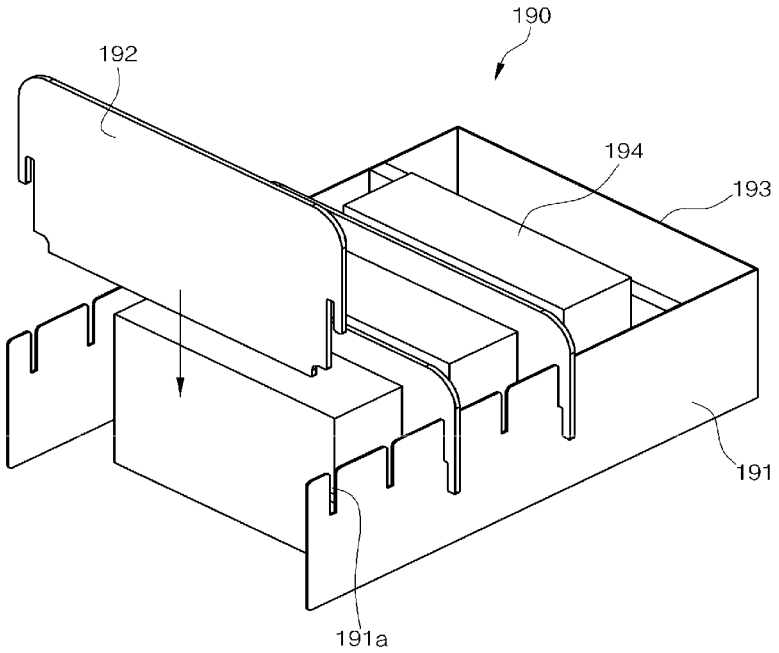
FIG. 6 shows an example of a prize cartridge of the present invention.
Figure 7:
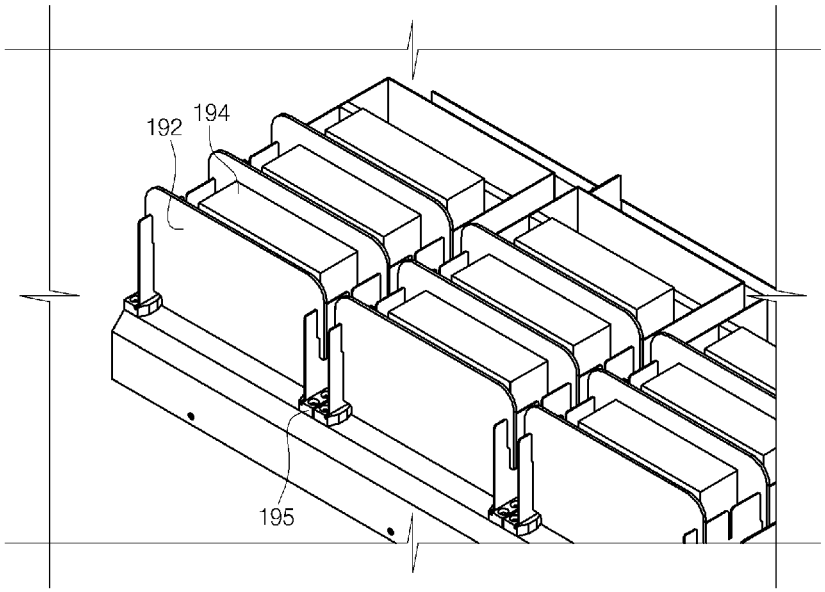
FIG. 7 shows a state in which prizes are mounted in the prize cartridges of the present invention.

Referring to FIG. 6, that shows an example of the prize cartridge of the present invention; and FIG. 7, that illustrates a state in which the prizes are contained in the prize cartridges of the present invention, each prize cartridge 190 includes a rear plate 193 supported by a bracket 121 of the corresponding drive part 120, opposite lateral plates 191 that are coupled to opposite ends of the rear plate 193 with one or more fitting slits 191*a* in an exhibited direction of the prizes 194, partitions 192 that are fitted into the fitting slits 191*a* and are made of a transparent material, and guide grooves 195 into which lower portions of the opposite lateral plates 191 are inserted and guided so as to slide.

Further, top and bottom faces of each prize cartridge 190 are open, wherein the prizes 194 contained in each prize cartridge 190, are supported by a top face of the corresponding drive part 120.

Thus, when the prize cartridge 190 is moved to a predetermined distance (distance of a space in which the prize is contained) by the drive part 120, the prize 194 contained in the space falls from the top face of the drive part 120 in a downward direction.

Figure 10:
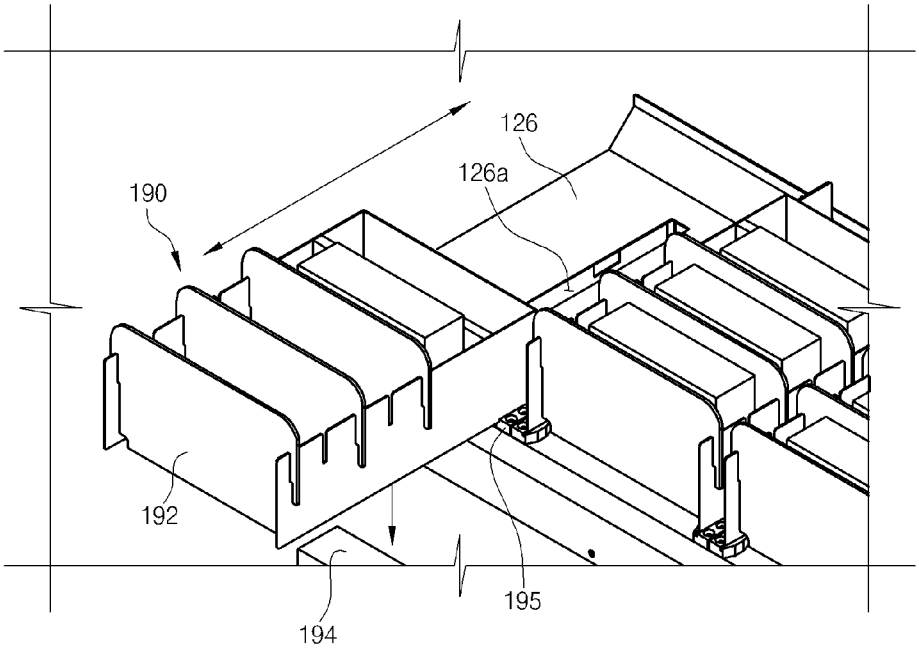
FIG. 10 shows a process in which the prize cartridge is operated.
Figure 11:
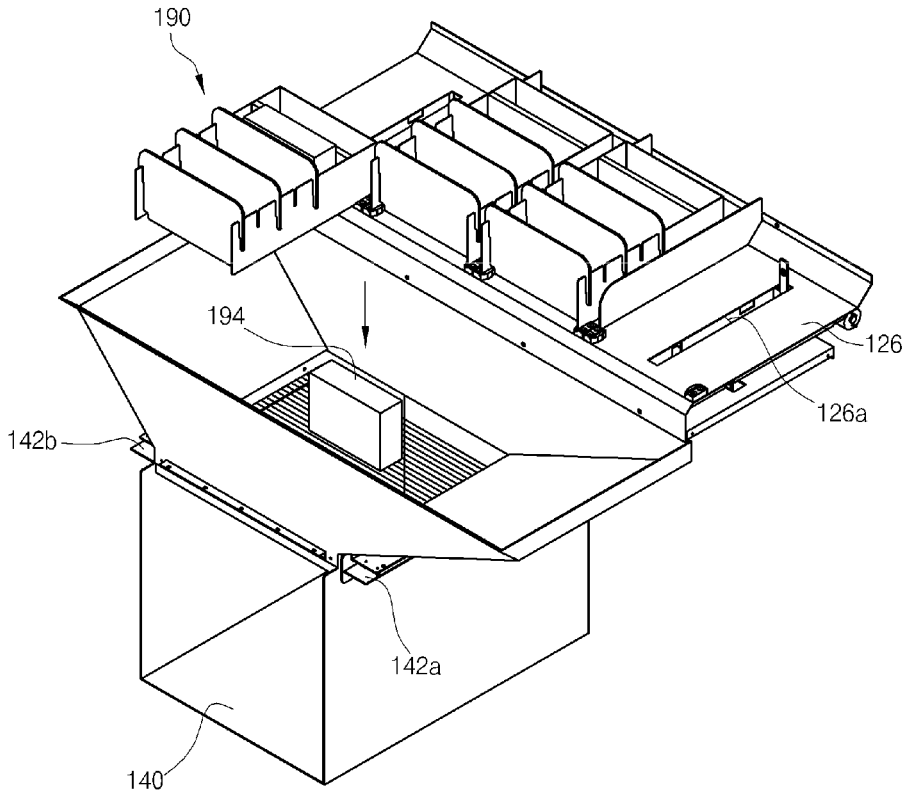
FIG. 11 shows a process in which the prize contained in the prize cartridge is input to a prize discharge part.

Referring to FIGS. 10 and 11, when the prize cartridge 190 is displaced from the top face 126 of the drive part 120, the prizes 194 are configured to fall down.

Further, the guide grooves 195 are not simple line shapes but approximate "L" shapes. Thus, the lower portions of the opposite lateral plates 191 inserted into the guide grooves are "L" shaped so as to correspond to the shapes of the guide grooves and allow them to be more reliably supported.

Since the prize cartridge 190 should return to its original position after being moved to a predetermined position by the bracket 121, the bracket 121 and the rear plate 193 of the prize cartridge 190 may be coupled by a coupling member or be fitted for easy separation by a fitting member.

The drive part 120 is designed to move the corresponding prize cartridge 190 so as to allow the prize 194 to fall down as a result of playing a game.

Figure 8:
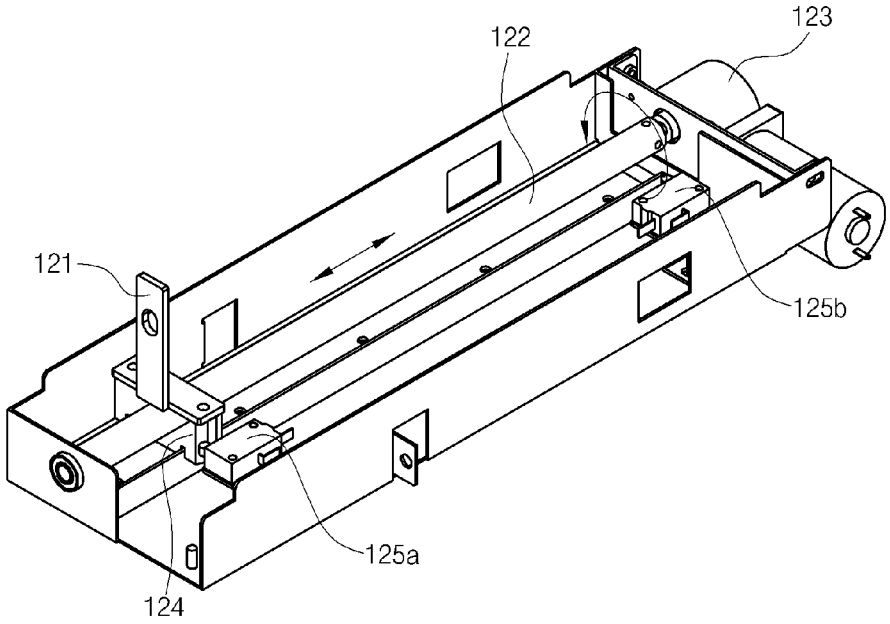
FIG. 8 is a perspective view showing a drive part of the present invention.
Figure 9:
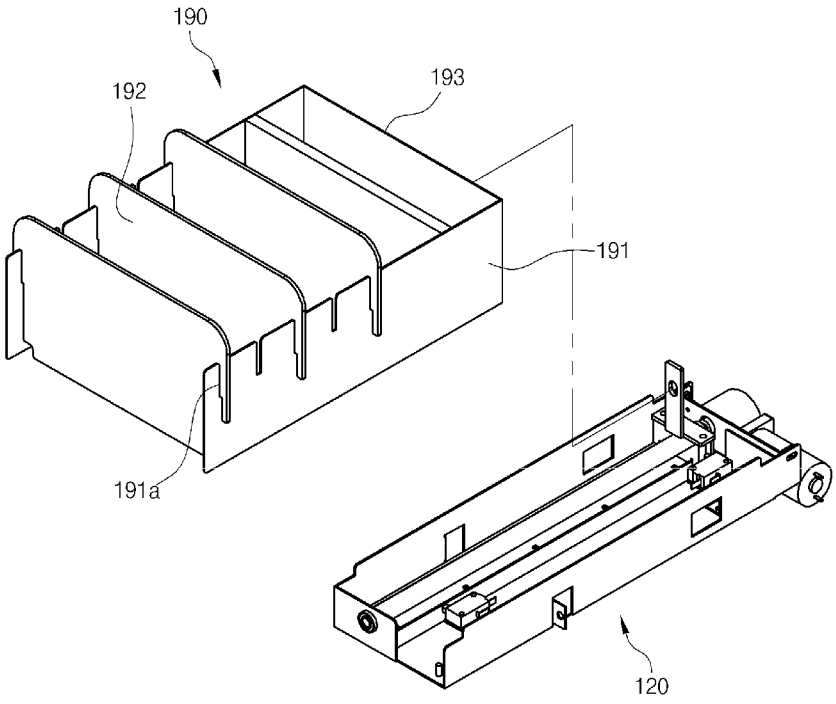
FIG. 9 shows a coupling relation between the prize cartridge and the drive part of the present invention.

Referring to FIG. 8, that illustrates the drive part of the present invention in a perspective view, the drive part 120 includes a bracket 121 supporting one end of the prize cartridge 190, a base bracket 124 to which the bracket 121 is coupled, an electroformed screw rod 122 coupled to the base bracket 124 by a nut, and a motor 123 rotating the electroformed screw rod 122. As the electroformed screw rod 122 is rotated by rotation of the motor 123, the bracket 121 is configured to move backward and forward.

The drive part 120 is equipped with a front sensor 125*a* that detects whether or not the prize falls during forward movement of the bracket 121, and a rear sensor 125*b* that detects backward movement of the bracket 121. The controller 110 controls the drive part 120 so as to stop the forward movement of the bracket 121 when the front sensor 125*a* is operated during the forward movement of the bracket 121, and to stop the backward movement of the bracket 121 when the rear sensor 125*b* is operated during the backward movement of the bracket of 121.

In detail, the front sensor 125*a* is configured to detect whether or not the prize, which is contained and separated in the front of the top face 126 by the partition when the prize cartridge 190 is moved forward by the drive part, is moved to a position at which it can fall. Thus, the front sensor 125*a* is used to control the falling of a single prize by stopping additional forward movement of the prize cartridge 190 when the corresponding prize falls.

That is, when it is determined that the front sensor 125*a* is actuated, the controller 110 limits the forward movement of the prize cartridge 190 so as to prevent another prize from falling.

Further, the rear sensor 125*b* is provided in the rear of the top face 126 and is used to prevent excessive backward movement when the bracket 121 moves backward.

Further, referring to FIGS. 10 and 11, an upper portion of the drive part 120 is assembled in a cover form by the top face 126, and a guide slot 126*a* guiding the movement of the bracket 121 is formed in the top face 126.

That is, the top face 126 is configured to guide the bracket 121 and to support a bottom face of the prize cartridge 190.

The gaming device 130 is configured to execute a game according to each of the identification numbers 134 of the prize cartridges 190 in which the desired prizes 194 are mounted.

The games according to the identification numbers may be equal to one another or can be different in the degree of difficulty or in type.

That is, as shown in FIG. 4, the embodiment of the present invention illustrates the games having the same degree of difficulty because the sizes of window holes 132*b* are equal to one another. However, the sizes of the window holes 132*b* may be made different according to the identification numbers so that the games may be different in the degree of difficulty.

The gaming device 130 includes targets 132 having the window holes 132*b*, extruders 131 operated parallel to a plane on which the targets 132 are exhibited, and rod-like members 131*a* moving perpendicular to the plane on which the targets 132 are exhibited by the operation of the extruders 131. The extruder 131 is operated toward the target 132 corresponding to the identification number 134 of the prize cartridge 190 in which the desired prize is mounted so as to execute the game.

In the present invention, the identification numbers range from 1 to 9, and the games corresponding to the respective identification numbers are also distinguished by 1 to 9. The prizes corresponding to the respective identification numbers are exhibited in the showcase.

When the player checks the identification number assigned to the desired prize, then when the player plays a game corresponding to the identification number using the gaming device, and subsequently wins the game, the desired prize can be discharged.

Figure 12:
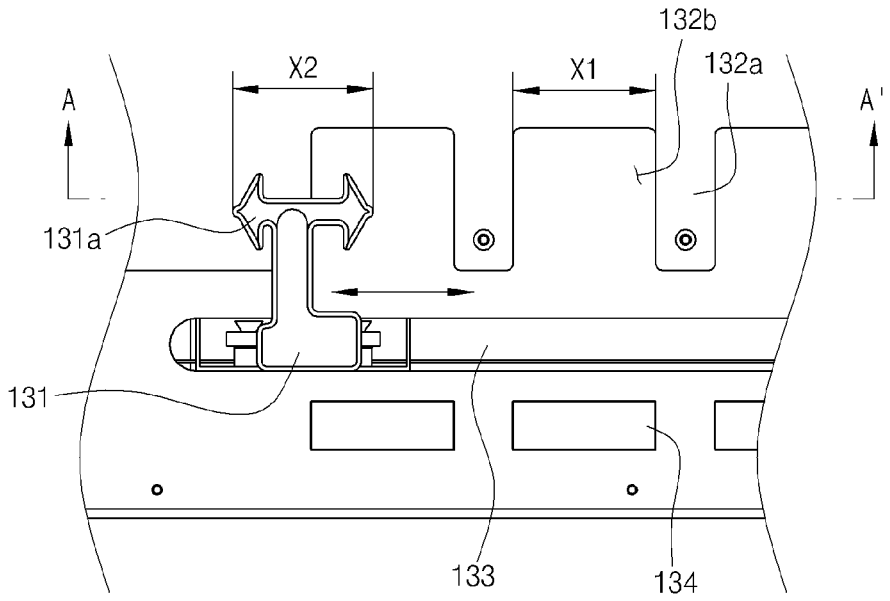
FIG. 12 shows an example of a gaming device of the present invention.
Figure 13:
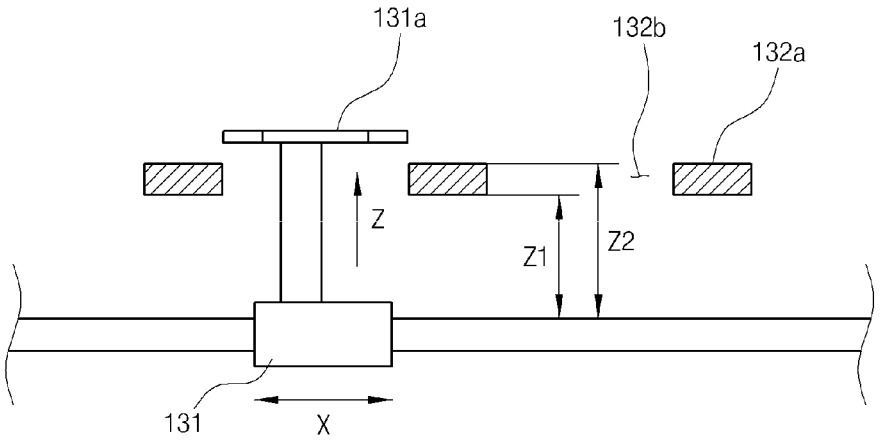
FIG. 13 shows an operational example of the gaming device according to an example of the present invention.

For example, referring to FIG. 12, that illustrates an example of the gaming device of the present invention, and FIG. 13, that shows an operational example of the gaming device according to an example of the present invention, the gaming device 130 of the present invention includes an extruder 131 that has a rod-like member moving in a forward/backward (Z) direction, a target 132 made up of a wall plate 132*a* that has window holes 132*b* and blocks the front, a support bracket 136 that supports the wall plate 132*a* and is marked with the identification numbers 134 of the prize cartridges 190, and a key operator 150 that moves the extruder 131 in a leftward/rightward (X) direction.

The identification numbers 134 are equal to the identification numbers 134 marked on the prize cartridges 190 and are differently marked according to the gaming device.

When the key operator 150 is operated to move the extruder 131 toward the target 132 corresponding to the identification number 134 of the prize cartridge 190, in which the desired prize is mounted in an X direction (in an arrow direction of FIG. 12) by the control of the controller 110, the rod-like member 131*a* having an arrow shape is moved in a Z direction (in a direction in which the prizes are exhibited). As a result, when a tip of the rod-like member 131*a* is inserted into and passes through the window hole 132*b*, the controller 110 controls the drive part 120 so that the prize corresponding to the identification number 134 of the penetrated wall plate is input to the prize discharge part 140.

Thus, a width $X_2$ of the rod-like member 131*a* is configured to be nearly equal to or slightly smaller than that $X_1$ of the window hole 132*b*. Thereby, the rod-like member 131*a* passes through the window hole 132*b* only when accurately identical to the width $X_1$ of the window hole 132*b*.

Further, when the rod-like member 131*a* is inserted deeper than a distance $Z_1$ from a plane on which the rod-like member 131*a* is located to the front of the window hole 132*b*, it is determined that the rod-like member 131*a* passes through the window hole 132*b*.

Preferably, when the rod-like member 131*a* is inserted by a width $(Z_2-Z_1)$ of the window hole 132*b*, it is determined that the rod-like member 131*a* passes through the window hole 132*b*.

In the aforementioned embodiment, it is described that the extruder 131 is moved in the X-axial direction. However, it is apparent that the extruder 131 may be moved in the Y-axial direction by a simple modification.

In detail, the gaming device 130 includes an extruder 131 that has a rod-like member moving in a forward/backward (Z) direction, a target 132 in which wall plates 132*a* that have window holes 132*b* and block the front are arranged in a vertical direction, a support bracket 136 that supports the wall plates 132*a* and is marked with the identification numbers 134 of the prize cartridges 190, and a key operator 150 that moves the extruder 131 in an upward/downward (Y) direction. When the key operator 150 is operated to move the extruder 131 in the (Y) direction (in a vertical direction), the rod-like member 131*a* is moved in the (Z) direction. As a result, when a tip of the rod-like member 131*a* is inserted into and passes through the window hole 132*b*, the controller 110 controls the drive part 120 so that the prize corresponding to the identification number of the penetrated wall plate is input to the prize discharge part 140.

Further, the gaming device is configured to be able to withdraw the corresponding prize according to a win or a loss. The present invention is not limited to the aforementioned gaming device. Thus, it is apparent that a variety of gaming devices may be used.

Figure 17:
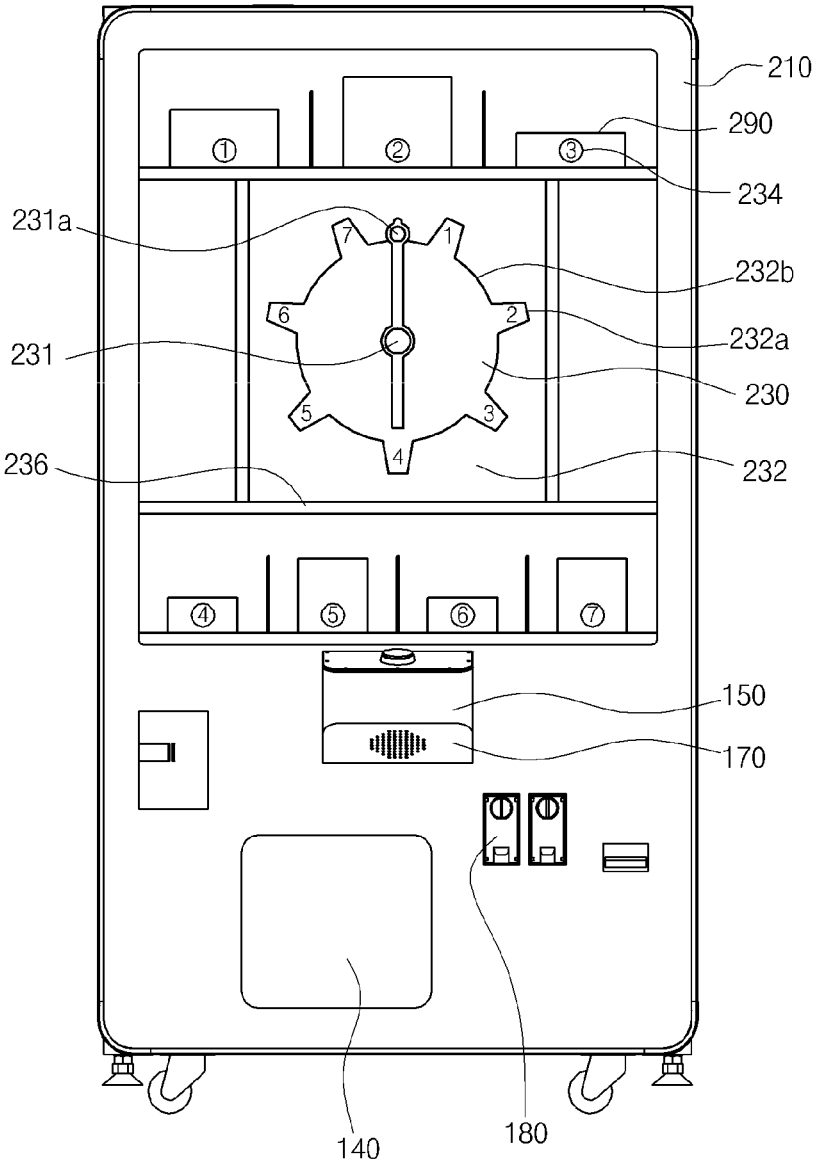
FIG. 17 is a perspective view of a merchandiser according to another embodiment of the present invention.

For example, as in FIG. 17, the gaming device includes a target 232 made up of a wall plate 232*b* which has one or more window holes 232*a*, which have a predetermined size as a circumference of a circular hole formed by a predetermined size, marked with different identification numbers and blocks the other region, an extruder 231 that has a rod-like member rotated around a rotational shaft in a shape of the hands of a clock and is moved in a forward direction ((Z) direction) that is a direction of the window hole 232*a*, a support bracket 236 that supports the wall plate 232*b* marked with the identification numbers 134 of the prize cartridges 190, and a key operator 150 that rotates and moves the extruder 131 in the forward direction ((Z) direction). When the key operator 150 is operated to rotate and move the extruder 231 toward the window hole corresponding to the identification number of a desired prize, the extruder 231 is moved in a (Z) direction. Then, when a tip 231*a* of the rod-like member passes through the window hole 232*a*, the controller 110 is configured to allow the prize corresponding to the identification number of the penetrated wall plate to be input to and discharged from the prize discharge part 140.

The controller 110 controls the drive part 120 to be driven according to a result of executing the gaming device 130 so that the prize of the prize cartridge 190 is input to the prize discharge part 140.

To this end, the controller 110 controls the drive part 120 to drive the prize cartridge 190 until it is detected by input detectors and the prize 194 of the prize cartridge 190 is input to the prize discharge part 140.

To be specific, referring to FIG. 11, that illustrates a process of the prize contained in the prize cartridge being input to the prize discharge part, the prize discharge part 140 has an approximate box shape and includes a light-emitting sensor 142*a* and a light-receiving sensor 142*b* operated as the input detectors 142 on opposite sidewalls. When the prize 194 falls from the prize cartridge 190, a signal received by the light-receiving sensor 142*b* is instantly interrupted due to the fall of the prize 194. Then, the controller 110 determines that the prize 194 is input to the prize discharge part 140. The controller 110 controls the drive part 120 to be stopped and reversely rotates a motor so as to return the prize cartridge 190 to its original position.

Reference number 230 indicates a shelf for exhibiting prizes.

Further, a blocking wall 143 is installed at a lower portion of the frame and is operated so as to control the discharge direction of the prize in such a manner that a player can or cannot discharge the prize 194 falling by pivoting of the blocking wall.

Figure 15:
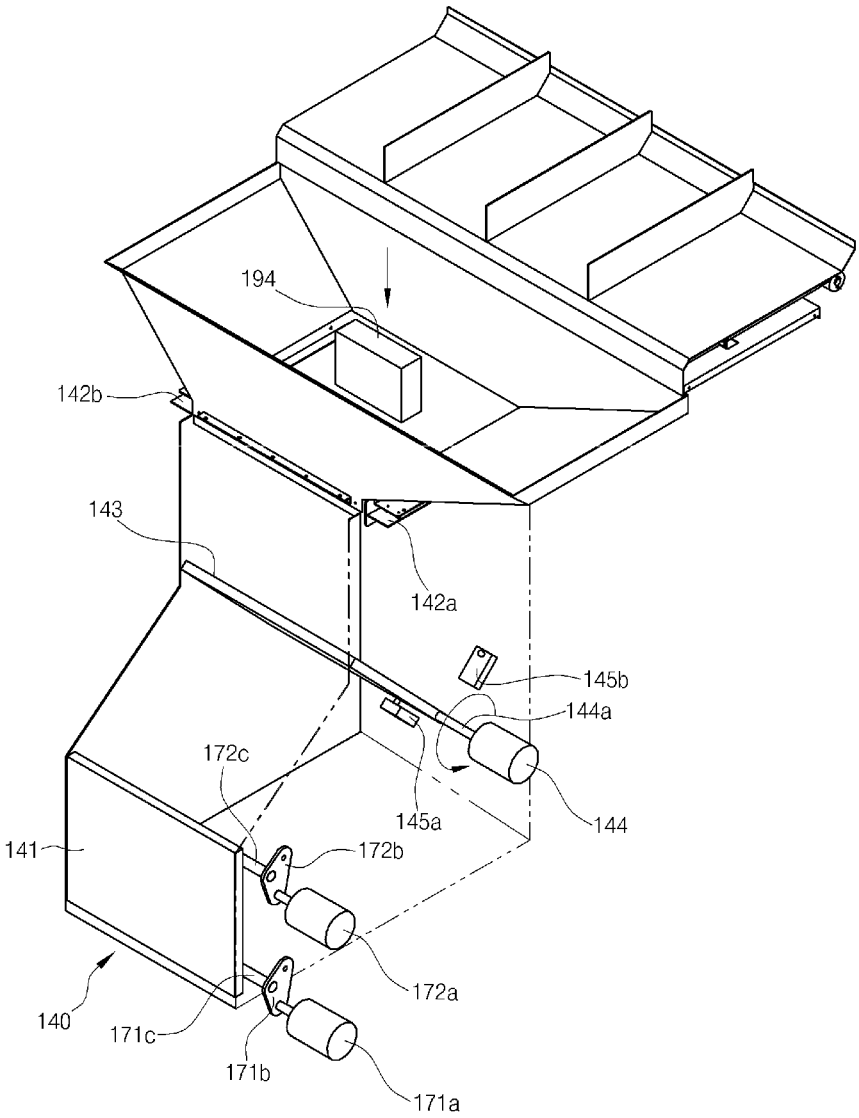
FIGS. 15 and 16 are views for describing an operational state of the prize discharge part of one embodiment of the present invention.
Figure 16:
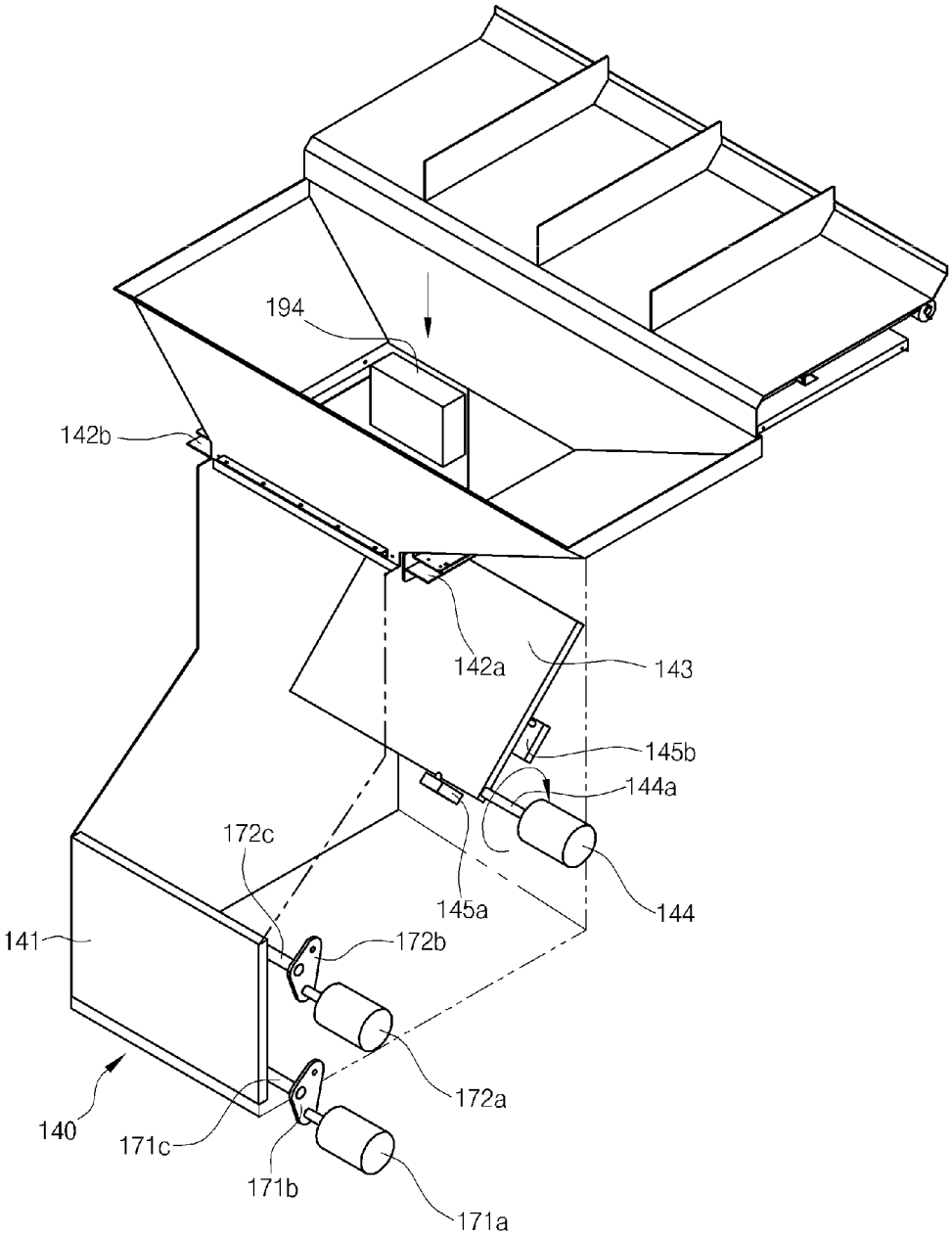

Referring to FIGS. 15 and 16, which are views for describing an operation of the prize discharge part, in accordance with an embodiment of the present invention, wherein FIG. 15 shows a locked state in which the prize 194 dropped from the prize cartridge 190 is kept at the lower portion of the frame without being discharged, and the prize dropped by the pivoting of the blocking wall 143 in a direction of the door 141 is controlled so as not to be discharged in the direction of the door. FIG. 16 shows an unlocked state in which the prize 194 dropped from the prize cartridge 190 is discharged in the direction of the door 141.

In the following description, a state in which the blocking wall pivots so that the dropped prize 194 is discharged in the direction of the door is referred to as an "unlocked state," and a state in which the blocking wall pivots so that the dropped prize 194 is discharged into the frame is referred to as a "locked state."

When it is determined that the result of executing the gaming device is determined to be a win while the blocking wall 143 is maintained in the locked state during the game, the controller 110 controls the blocking wall 143 to pivot in the unlocked state so that the prize 194 input to the prize discharge part 140 is discharged through the door 141.

When the prize 194 of the prize cartridge 190 is detected to be input to the prize discharge part 140 by the input detectors 142 or by the front sensor 125*a* of the driving part, the controller controls the blocking wall 143 to pivot in the locked state after a predetermined time has elapsed so as to prevent the prize from being discharged.

That is, when a predetermined time has elapsed after a game is played, the controller 110 drives a motor 144 to determine that the blocking wall 143 pivots in the locking state, and controls the blocking wall 143 to be maintained in the locked state during the game. Thereby, when the prize is dropped by vibration or illegal action, the prize can be prevented from being discharged outside.

Further, sensors are attached at positions at which the blocking wall 143, having a plate shape, is rotated to a maximum position in the locked and unlocked states. When the blocking wall 143 is rotated at the maximum rotational angle, the corresponding sensor is operated. Thereby, the motor 144 can be controlled so that the blocking wall 143 is not rotated more than needed. As such, the state of the blocking wall 143 can be accurately controlled, and the blocking wall 143 can be prevented from being damaged by excessive rotation.

That is, a locking detector 145*a* detecting the locked state, and an unlocking detector 145*b* detecting the unlocked state, are provided at positions at which the maximum pivoting direction of the blocking wall 143 can be detected. When the motor 144 is controlled so that the blocking wall 143 pivots in the locked state, the controller 110 stops driving the motor 144 so that the blocking wall 143 does not pivot excessively when the locking detector 145*a* is actuated. When the motor 144 is controlled so that the blocking wall 143 pivots in the unlocked state, the controller 110 stops driving the motor 144 to prevent the blocking wall 143 from being rotated excessively when the unlocking detector 145*b* is actuated.

Meanwhile, in the present invention, to forcibly hinder the pivoting of the blocking wall 143 to prevent the prize 194 from being illegally discharged through the door, a device that can control the on/off capability of the door may be provided additionally or separately from the blocking wall 143.

For example, the prize discharge part 140 is provided with a door 141 pivoting around a rotational shaft with an upper end thereof and a stopper 171*c* preventing the door from pivoting, thereby preventing the forcible pivoting of the door and the illegal acquisition of the prize. In this process, when it is detected that the input detectors 142 or the front sensor 125*a* is operated, the stopper 171*c* is controlled to prevent the door 141 from pivoting.

Here, the controller 110 prevents opening of the door 141 by upward movement of the stopper 171*c* so that a lower end of the door is caught in the rear of the door 141 in a rotating direction in a standby state in which a start of a game is on standby or during a game. In the meantime, when it is detected by the input detectors 142 or the front sensor 125*a* that the prize is input to the prize discharge part 140, a position of the stopper moves downward so that the lower end of the door is rotated without being caught on the stopper.

In another method, a rotary screw 172*c* is coupled on a rotation shaft of the door 141 and is driven by a motor 172*a*. Thereby, the rotation of the door 141 can be restricted by rotation and stop of the motor.

That is, the motor 172*a* controlled by the controller 110 and the door rotatably screwed to the motor 172*a*, are provided. Thereby, the opening and closing of the door can be controlled.

The opening and closing are controlled as follows. The motor 172*a* is driven to prevent the opening of the door in a standby state or during a game. In the meantime, when the door is detected by the input detectors 142 or the front sensor 125*a* that the prize is input to the prize discharge part 140, the door is opened by driving the motor 172*a*.

As described above, when the prize 194 is normally discharged by controlling the rotation of the door 141, the door 141 is opened so that the prize is discharged.

A method of controlling a game of the merchandiser using this merchandiser will be described with reference to the drawings.

Figure 14:
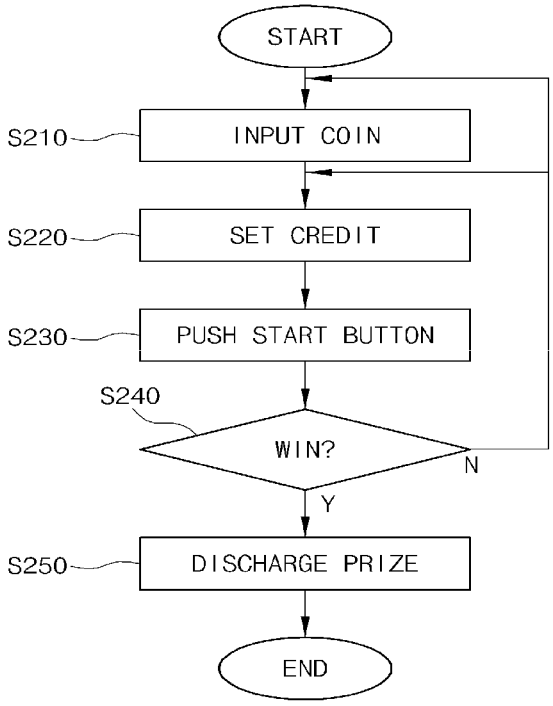
FIG. 14 is a flowchart for describing a method of playing a game of the merchandiser of the present invention.

FIG. 14 is a flowchart for describing a method of playing a game of a merchandiser of the present invention. As shown, in a method of playing a game of the merchandiser acquiring a prize of the corresponding identification number 134 according to a win or loss of each game using the prize cartridges 190 in which the prizes 194 are contained and have the identification numbers 134, drive parts 120 moving the prize cartridges 190, and the gaming device 130 having the targets 132 provided for the respective identification numbers 134 of the prize cartridges 190, first, a player inputs a coin into the money recognizer 180, sets credit, and starts a game (S210 to S220).

When the setting of credit is completed in step S220, the player pushes a start button of the key operator 150 to start a game (S230). The controller 110 determines whether or not the game is won (S240).

In step S240, the game is played with the gaming device provided for each identification game, and a win or loss is decided. When the result of playing the game in step S240 is determined to be a win, the driving part 120 is controlled so that the prize 194 of the prize cartridge 190 corresponding to the identification number 134, is discharged to the prize discharge part 140.

To be more specific, in step S240, the player checks the identification number 134 of the prize cartridge 190 in which the desired prize 194 is mounted and moves the extruder 131 having the rod-like member 131*a* in a leftward/rightward (X) or upward/downward (Y) direction using the button of the key operator 150.

When the targets 132 are exhibited in the (X) direction, the extruder 131 is moved in the (X) direction. When the targets 132 are exhibited in the (Y) direction, the extruder 131 is moved in the (Y) direction.

Afterwards, when the tip of the rod-like member 131*a* passes through the window hole 132*b* by moving the extruder 131 in a direction of the targets 132 that provide wall plates 132*a*, which have window holes 132*b* and block the front, and are provided for the respective prize cartridges 190, it is determined to be a win in the game.

The extruder 131 is moved in the (X) or (Y) direction by the operation of the key operator 150, and when it is determined that the movement is completed, the controller 110 controls the extruder 131 to be driven so that the rod-like member 131*a* is moved in a direction of the target 132.

Further, in step S250, when the result of playing the game in the previous step is determined to be a win, the drive part 120 is driven to move the prize cartridge 190 to which the identification number 134 associated with the corresponding game is given so that the prize 194 of the prize cartridge 190 is dropped. When it is determined that the prize 194 of the prize cartridge 190 is dropped and input to the prize discharge part 140, it is controlled to stop driving the drive part 120 and to return the prize cartridge 190 to its original position.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A merchandiser that provides a designated prize according to a result of playing a game, the merchandiser comprising:

one or more prize cartridges that have partitions among which prizes are contained and are distinguished by different identification numbers;

drive parts that drive the respective prize cartridges in a forward/backward direction and have front sensors limiting a forward movement distance;

a gaming device that executes the game provided for each of the identification numbers of the prize cartridges;

a prize discharge part from which the contained prizes are discharged; and a controller that drives the drive part when a result of playing the game of the gaming device is determined to be a win and moves the prize cartridge in a forward direction so that the prize is dropped to the prize discharge part.

2. The merchandiser of claim 1, wherein the controller controls the drive part when it is detected by input detectors or the front sensor that the prize of the prize cartridge is input to the prize discharge part so that the prize cartridge is moved in a backward direction.

3. The merchandiser of claim 2, wherein the prize discharge part further includes a blocking wall that is operated in an unlocked state in which the prize input by pivoting is discharged and in a locked state in which the input prize is hindered from being discharged, and the controller controls the blocking wall in the unlocked state when the result of playing the game of the gaming device is determined to be a win so that the prize input to the prize discharge part is discharged.

4. The merchandiser of claim 3, wherein the controller controls the blocking wall in the locked state when a predetermined time has elapsed after it is detected by the input detectors or the front sensor that the prize of the prize cartridge is input to the prize discharge part.

5. The merchandiser of claim 1, wherein the prize discharge part further includes:

a door pivoting around a rotational shaft with an upper end thereof; and a stopper preventing the pivoting of the door, and the controller controls the stopper depending on a result of the detection of the input detectors or the front sensor so as to prevent the pivoting of the door.

6. The merchandiser of claim 5, wherein the controller controls the stopper when it is detected by the input detectors or the front sensor that the prize is input to the prize discharge part so as not to hinder the pivoting of the door and so as to prevent the pivoting of the door after a predetermined time has elapsed.

7. The merchandiser of claim 6, further comprising a display part or an acoustic part at one side of the door, wherein the controller controls the display part or the acoustic part to convey a message informing of the closing of the door.

8. The merchandiser of claim 1, wherein the prize discharge part further includes:

a motor; and a door that is rotatably coupled with the motor and pivots around a rotational shaft with an upper end thereof according to rotation of the motor, and the controller controls the motor depending on whether it is detected by the input detectors or the front sensor that the prize of the prize cartridge is input to the prize discharge part so as to prevent pivoting of the door.

9. The merchandiser of claim 8, wherein the controller controls the motor when it is detected by the input detectors or the front sensor that the prize is input to the prize discharge part so as not to hinder the pivoting of the door and so as to prevent the pivoting of the door after a predetermined time has elapsed.

10. The merchandiser of claim 1, wherein the drive part includes:

a base bracket;

a bracket that is mounted on the base bracket and supports one end of the prize cartridge;

an electroformed screw rod that couples the bracket with a nut; and a motor that rotates the electroformed screw rod, and the bracket is moved backward and forward while the electroformed screw rod is rotated by rotation of the motor.

11. The merchandiser of claim 1, wherein the prize cartridge includes:

a rear plate supported by a bracket of the drive part;

opposite lateral plates that are coupled to opposite ends of the rear plate and have one or more fitting slits in an exhibited direction of the prizes;

partitions that are fitted into the fitting slits depending on a size of the prize; and guide grooves into which lower portions of the opposite lateral plates are inserted and guided so as to slide.

12. The merchandiser of claim 1, wherein the gaming device includes:

an extruder that has a rod-like member moving in a forward/backward (Z) direction;

a wall plate that has window holes and blocks the front;

a support bracket that supports the wall plate and is marked with the identification numbers of the prize cartridges; and a key operator that moves the extruder in a leftward/rightward (X) direction, and when the key operator is operated to move the extruder in the (X) direction, the rod-like member is moved in the (Z) direction, and then, when a tip of the rod-like member is inserted into and passes through the window hole, the controller controls the drive part so that the prize corresponding to the identification number of the penetrated wall plate is input to the prize discharge part.

13. The merchandiser of claim 1, wherein the gaming device includes:

an extruder that has a rod-like member moving in a forward/backward (Z) direction;

a wall plate that has window holes and blocks the front;

a support bracket that supports the wall plate and is marked with the identification numbers of the prize cartridges; and a key operator that moves the extruder in an upward/downward (Y) direction, and when the key operator is operated to move the extruder in the (Y) direction, the rod-like member is moved in the (Z) direction, and then, when a tip of the rod-like member is inserted into and passes through the window hole, the controller controls the drive part so that the prize corresponding to the identification number of the penetrated wall plate is input to the prize discharge part.

14. The merchandiser of claim 1, wherein the gaming device includes:

an extruder that has a rod-like member rotated or moving in a forward/backward (Z) direction;

a wall plate that has window holes and blocks the front;

a support bracket that supports the wall plate and is marked with the identification numbers of the prize cartridges; and a key operator that rotates or moves the extruder in the forward/backward (Z) direction, and when the key operator is operated to rotatably move the extruder, the rod-like member is moved in the (Z) direction, and then, when a tip of the rod-like member is inserted into and passes through the window hole, the controller controls the drive part so that the prize corresponding to the identification number of the penetrated wall plate is input to the prize discharge part.

15. A merchandiser that provides a designated prize according to a result of playing a game, the merchandiser comprising:

a box-shaped frame, at least one face of which is transparent so as to look inside;

a prize showcase in which prizes are exhibited on one plane of the frame in a matrix pattern at a leftward/rightward (X) or upward/downward (Y) exhibition position, are contained by partitions, and have different identification numbers;

one or more targets which are provided on the same plane as the prize showcase, in which wall plates having window holes and blocking the front are disposed in a leftward/rightward (X) or upward/downward (Y) direction, and which are marked with different identification numbers of the prize showcase;

an extruder having a rod-like member moving in a (Z) direction in which the targets are located within a plane located outside the showcase; and a key operator moving the extruder in the leftward/rightward (X) or upward/downward (Y) direction.

16. The merchandiser of claim 15, wherein the showcase includes:

one or more prize cartridges in which the prizes are contained in the (Z) direction; and drive parts driving the respective prize cartridges.

17. The merchandiser of claim 15, wherein the prize cartridge includes:

a rear plate supported by a bracket of the drive part;

opposite lateral plates that are coupled to opposite ends of the rear plate and have one or more fitting slits in an exhibited direction of the prizes;

partitions that are fitted into the fitting slits depending on a size of the prize; and guide grooves into which lower portions of the opposite lateral plates are inserted and guided so as to slide.

18. The merchandiser of claim 15, wherein the drive part includes:

a bracket that supports a rear plate of the prize cartridge;

an electroformed screw rod that couples the bracket with a nut; and a motor that rotates the electroformed screw rod, and the bracket is moved backward and forward while the electroformed screw rod is rotated by rotation of the motor.

* * * * *